United States Patent [19]

Matsumoto et al.

[11] Patent Number: 4,673,284

[45] Date of Patent: Jun. 16, 1987

[54] CLEANING DEVICE

[75] Inventors: Fuyuhiko Matsumoto, Wako; Shuuichi Tsushima, Tokyo, both of Japan

[73] Assignee: Ricoh Company, Ltd., Tokyo, Japan

[21] Appl. No.: 258,033

[22] Filed: Apr. 24, 1981

[30] Foreign Application Priority Data

Apr. 26, 1980 [JP] Japan ..... 55-55623

[51] Int. Cl.[4] ..... G03G 21/00

[52] U.S. Cl. ..... 355/15; 15/1.5 R; 15/256.51

[58] Field of Search ..... 355/3 R, 15; 15/1.5, 15/256.51, 256.52

[56] References Cited

U.S. PATENT DOCUMENTS

| | | | |
|---|---|---|---|
| 2,751,616 | 6/1956 | Turner et al. | 355/15 X |
| 2,894,744 | 7/1959 | Schulze | 15/1.5 X |
| 3,071,791 | 1/1963 | Cunningham et al. | 15/1.5 R |
| 3,848,994 | 11/1974 | Fraser | 15/1.5 R X |
| 3,957,509 | 5/1976 | McMullen et al. | 355/15 |
| 4,213,794 | 7/1980 | Wooding et al. | 355/15 X |

OTHER PUBLICATIONS

Harmon et al; "Cleaning Brushes that Prevent Clear Film Streaking", IBM Technical Disclosure Bulletin, vol. 15, No. 5, Oct. 1972, p. 1434.

*Primary Examiner*—Fred L. Braun

*Attorney, Agent, or Firm*—Oblon, Fisher, Spivak, McClelland & Maier

[57] ABSTRACT

A cleaning device for removing the residual toner particles on the insulating surface in a two color printing apparatus includes a rotatable cleaning brush having two kinds of fiber materials charged the opposite polarities, and a flicker device is also provided for flicking the brush to remove toner particles therefrom as the brush rotates.

17 Claims, 6 Drawing Figures

CLEANING DEVICE

BACKGROUND OF THE INVENTION

1. Field of the Invention

The present invention relates generally to an electrophotographic printing apparatus and more particularly to a device for the removal of particles adhering electrostatically to an insulating surface in a two-color electrostatographic machine.

2. Description of the Prior Art

A novel and unique two color electrostatic copying machine is disclosed in the U.S. Pat. Nos. 4,189,224 and 4,250,239, and in the U.S. Pat. Nos. 4,335,194 and 4,310,610 assigned to Ricoh Company, Ltd. The present invention constitutes an improvement to the cleaning device in the basic two-color copying machine.

A two color copying machine disclosed in the aforesaid patents comprises a photoconductive drum which is formed with a grounded, electrically conductive core, and inner and outer photoconductive layers of different spectral sensitivities. Around the drum, the following units are arranged:

First and second chargers applying electrostatic charges of opposite polarities to the drum to form a stratified charge pattern thereon. Exposure unit for radiating a light image to form an electrostatic image according to respective colors on the photoconductive layers of the drum. First and second developing units for applying positively charged toner of one color and negatively charged toner of the other color respectively to the drum to form a two-color toner image thereon. Pre-charger unit for converting the toner image having opposite polarities to one uniform polarity. Feed means for feeding a copy sheet into engagement with the drum at the same surface speed as that of the drum to transfer the toner image to said copy sheet. Transfer charger for applying the charge to the back of the copy sheet to facilitate the toner image transfer. Discharge unit for discharging the drum and cleaning unit for removing any residual toner particles therefrom prior to the next copying operation.

In such a copying machine, the cleaning element typically comprises a rotatable brush with a core having a plurality of fibers extending radially outwardly therefrom. The brush sweepingly engages the photoconductive drum surface to remove the residual toner particles therefrom. Such brush fibers are formed of soft hairs, for example, of a bear or a beaver, and the brush fibers are made from a single kind of material. Consequently, while the brush can effectively remove the toner particles of one polarity, it is not always suitable to remove the toner particles of the other polarity with a result that residual toner particles left on the photoconductive drum can affect the next copying operation.

The above-mentioned problem results from the electrostatic images formed in opposite polarities in the stratified charge pattern on the surface of each photoconductive layer corresponding to respective colors. Although, prior to cleaning, pre-charge, transfer charge, and discharge are applied to the surface of the drum, such charging is not always sufficient to enable the above-mentioned cleaning unit to clean the surface of the drum thoroughly It is especially difficult to remove the residual toner particles corresponding to the electrostatic image on the inner photoconductive layer.

In order to solve this problem, two brush fiber rollers wherein each fiber is charged with opposite polarities may be used, but this is still undesirable because it tends to make the cleaning unit bigger.

The present invention has been made to solve the aforesaid drawbacks in a two-color copying machine.

SUMMARY OF THE INVENTION

It is therefore a primary object of the present invention to provide an improved cleaning means for removing the residual toner particles from the insulating surface of a two-color printing apparatus.

Another object of the present invention is to provide a simple and small cleaning unit which can remove the residual toner particles having respective polarities from the surface of the photoconductive member.

In accordance with a presently preferred embodiment of the present invention, the cleaning unit of a two-color electrophotographic printing apparatus may be modified by using a cleaning brush having a plurality of fibers on the cylindrical core, which comprise two kinds of fiber materials. One kind of fiber material can remove the positively charged toner particles and the other kind can remove the negatively charged toner particles. One of the fiber materials may be poly-4-fluoroethylene fibers, and the other may be another fiber material, each of the materials in contact with the insulating surface being triboelectrically charged with opposite polarities.

DETAILED DESCRIPTION OF THE PREFERRED EMBODIMENTS

Figure 1:
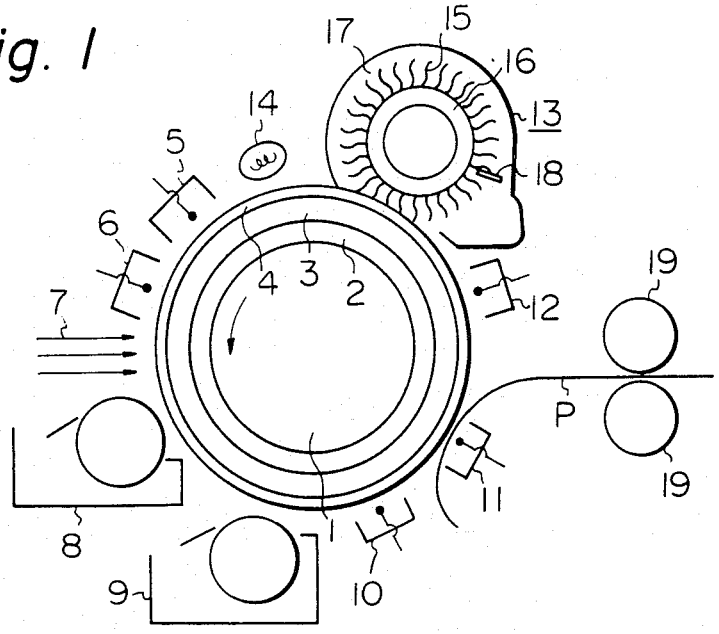
FIG. 1 is a schematic view of a two-color electrostatic copying machine embodying the present invention.

Referring now to FIG. 1 of the drawing, a two-color electrostatic copying machine is illustrated. This machine comprises a photoconductive drum 1 having a grounded electrically conductive core 2, inner photoconductive layer 3, and outer photoconductive layer 4. Each of the photoconductive layers has different spectral sensitivities. First charger 5 applies a uniform positive charge to the surface of the drum 1, and second charger 6 applies a negative charge to the drum 1 in the dark, whereby a uniform stratified charge pattern is formed thereon. Radiation of a light image 7 onto the drum 1 causes an electrostatic image to be formed on the layers according to respective colors, such as black and red of the light image 7. First developing unit 8 applies positively charged toner particles of a color such as red, and second developing unit 9 applies negatively charged toner of a color such as black. Thus, a two-color toner image is formed on the drum 1. The toner image on the surface of the drum 1 is converted to a uniform polarity e.g. positive, by precharger 10. Copy sheet P is fed into engagement with the drum at the same surface speed as that of the drum by feed means (not shown) to transfer the toner image onto the copy sheet. Transfer charger 11 applies the negative transfer charge to the back of the copy sheet P to facilitate the toner image transfer. The toner image is fixed to the copy sheet P through application of heat by heat rollers 19 (and a pressure roller if desired) to produce a finished and permanent copy.

After the transfer of the developed image to a copy sheet, discharger 12 discharges the drum 1, cleaning unit 13 removes any residual toner therefrom, and quenching lamp 14 discharges the drum 1 thoroughly prior to the next copying operation.

The cleaning unit 13 comprises a rotatable brush 17 with a core 16 having a plurality of fibers 15 extending radially outwardly therefrom. The brush fibers 15 may be formed of two kinds of fiber materials. One of the materials, for example, poly-4-fluoroethylene fiber (TEFLON-trade mark) is triboelectrically charged with the negative polarity through contact with the drum 1. The other material, which may be rayon fiber or polyester fiber, is also triboelectrically charged but with the positive polarity.

The cleaning brush 17 is supported to rotate within the cleaning unit 13 in the clockwise or counter-clockwise direction, preferably in the same direction as that of the drum 1. The cleaning brush 17 is in contact with the surface of the drum 1, and each brush fiber removes residual toner particles by electrostatic force of attraction.

A flicker plate 18 is axially arranged parallel to the brush 17 and serves to flick the brush fibers 15 in the conventional manner as the brush rotates in order to facilitate the separation of the toner particles from the brush fibers 15.

The following embodiments shown in FIG. 2 to FIG. 6 of the drawings relate to formation and distribution of the two kinds of fiber materials of the cleaning brush of the present invention.

Figure 2:
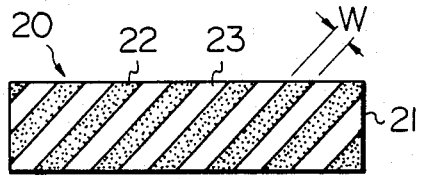
FIG. 2 and FIG. 3 show lateral elevations of cleaning brushes of the present invention.

The first embodiment is illustrated in FIG. 2 of drawing. TEFLON fibers and rayon fibers are put through separate long pieces of cloth. Each piece of cloth is alternately pasted on to the core 16 in a helical form. Thus, on the cleaning brush roller 20, two helical areas 22,23 of TEFLON fibers and rayon fiber respectively are formed. The width W of each cloth is less than 30 mm, preferably 20 mm in order to avoid uneven cleaning.

Experiment 1

A laboratory apparatus which corresponds to the copying machine shown in FIG. 1, was constructed.

A photoconductive member was formed of an aluminum substrate, a first photoconductive layer of zinc oxide resin sensitized with Rose bengale (zinc oxide:resin=3:1 by weight, the resin being KR 214 silicone resin available from Sinetsu Kagaku Co. of Japan) coated to a thickness of 10 microns on the substrate/and a second photoconductive layer of the organic composition of a 1:1 mixture of poly-N-vinylcarbozole (PVK) and 2,4,7-trinitro-9-fluorenon (TNF) coated to a thickness of 20 microns. The first photoconductive layer was insensitive to red light but sensitive to green light whereas the second layer had a panchromatic light sensitivity. Primary charging was performed in the dark at +6.5 KV to produce to +1800 V of surface potential and, thereafter, secondary charging was effected also in the dark at −4.8 KV to lower the surface potential to +600 V. A light image of an original document having a black area and a red area on a white background was radiated onto the member, and surface potentials of +400 V, +30 V and −600 V were produced in the black area, white area and red area, respectively. The black area was developed using a negatively charged black toner of −13 u coulomb/gram and the red area was developed using a positively charged red toner of +10 u c/g by magnetic brush development. And, after the transfer of each toner image to the copy sheet, the amount of the residual black toner on the surface of the drum was 0.11 mg/cm$^2$ and that of the red toner was 0.15 mg/cm$^2$.

Next, after the transfer unit, the discharger unit and the cleaning unit were mounted. The cleaning brush 20 was formed with each fiber cloth having width W of 20 mm with the length L of each fiber being 15 mm. About 8 mm of the leading edge of the fiber brush was brought into contact with the photoconductive drum, and the ratio of the circumferential velocity of the cleaning brush 20 and the drum 1 was set at 15:1. In these conditions, the efficiency of cleaning of the black toner particle was 93 percent, and that of the red toner was 95 percent.

The efficiency of cleaning is defined as the ratio of the mounds of removed toner particles from the surface of the photoconductive drum to that of the residual toner particles before the cleaning on the surface of the drum.

Experiment 2

The procedure of Experiment 1 was repeated with the exception of the cleaning brush 20 using polyester fibers instead of rayon fibers. The efficiency of cleaning was 97 percent with respect to the respective toner particles.

Figure 3:
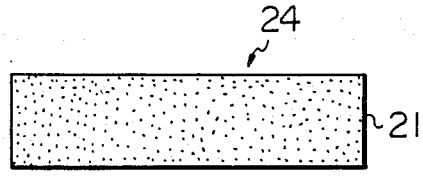
Figure 4:
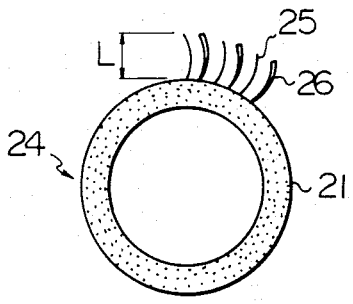
FIG. 4 is a cross section taken along the lines 2—2 of FIG. 3.

Second embodiment of the present invention is illustrated in FIG. 3 and FIG. 4. In this cleaning brush roller 24, TEFLON fibers 25 and rayon fibers 26 are put through a piece of cloth in a uniform density but in a random mixture of each fiber on the core 21. In this brush, the density of each fiber is important in respect of the efficiency of cleaning. Density is defined as (diameter of a fiber)×(number of the fibers at a unit area). The ratio of the density of the TEFLON fibers to rayon fibers is set at a range of 5 to 1/5, preferably of 3 to $\frac{1}{3}$. This ratio of the density is determined by the mass of each toner particle used in developing. Usually a two color original document has a larger black area than a red area on the white background, so the number of brush fibers to be used to remove black toner particles should be more than the number fibers used to remove red toner particles.

Experiment 3

The procedure of Experiment 1 was repeated using the cleaning brush 24 of the second embodiment. The ratio of the density of the TEFLON fibers to the rayon fibers was set at 2:1. The efficiency of cleaning of the black toner was 97 percent, and that of the red toner was about 100 percent.

Experiment 4

Instead of rayon fiber, polyester fiber was used and the ratio of the density of the TEFLON fiber to the polyester fiber was set at 1:1. With this cleaning brush 24, the procedure of Experiment 1 was performed. The efficiency of cleaning was about 100 percent in respect of both toner particles.

Figure 5:
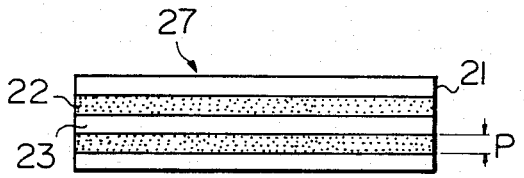
FIG. 5 and FIG. 6 are side views of other embodiments of the present invention.

Third embodiment of the present invention is disclosed in FIG. 5. In this cleaning brush 27, the TEFLON fibers and the rayon fibers are put through a piece of cloth on the core 21 in a form of the alternate band area 22,23 arranged in the axial direction. The pitch P of each band area 22, 23 of the fiber materials is preferably less than 50 mm. Because the black toner particles are used in a greater amount than the red toner particles, the pitch of fiber material for removing the black toner is preferably larger than that of fiber for removing the red toner. For example, as the black toner particles were charged with positive polarity and the red toner particles with negative polarity, it is desirable that the pitch 22 of the TEFLON fibers be 50 mm, and that the pitch 23 of the rayon fibers be 10 mm. In this embodiment, the polyester fiber may also be used instead of the rayon fiber.

Experiment 5

The procedure of the Experiment 1 was repeated using the cleaning brush 27 of this embodiment, each fiber material having a pitch of 20 mm. The efficiency of cleaning of the black toner particles was 94 percent, and that of the red toner particles was 95 percent.

Figure 6:
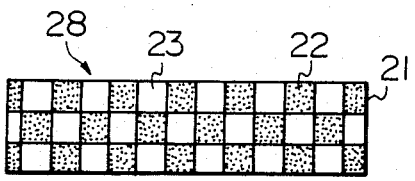

Fourth embodiment of the present invention is disclosed in FIG. 6. In this cleaning brush 28, the TEFLON fibers and the rayon fibers are put through a piece of cloth on the core 21 in a checkered form. For the same reason mentioned in the third embodiment, the area 22 of the TEFLON fibers is preferably larger than that of the rayon fibers. The area 22 of Teflon fibers is preferably at a range of 20 to 80 percent of the total circumferential area of the core. In addition, the areas of both the TEFLON fibers and rayon fibers have to be arranged in any position rayon fibers in the axial direction of the brush roller 28. In this cleaning brush 28, the polyester fiber may also be used instead rayon fiber.

Experiment 6

The procedure of the Experiment 1 was repeated using the cleaning brush 28 in which square areas with one side of 30 mm were formed. The efficiency of cleaning of the black toner particles was 96 percent and that of 15 the red toner particles was 97 percent. In every embodiment, an electrically conductive fiber material may be used in place of rayon or of polyester.

It will therefore be appreciated that the cleaning unit has a brush roller having two kinds of fiber materials charged with opposite polarities whereby extremely simple but effective means can be provided for removing the residual toner particle in a two-color electrostatic copying machine. Although the present invention has been described as applied to a photoconductive drum having two photoconductive layers in a two color copying machine, it will be appreciated that the present invention may be similarly applied to an insulating surface having two kinds of toner particles charged with opposite polarities. Further, the modification of the present invention could be made by using other means to achieve the same object. It is therefore intended that the following claims be construed as covering all such alterations and modification as fall within the true spirit and scope of the invention.

What is claimed is:

1. A cleaning device for removing residual toner particles from the insulating surface of an image bearing member of a device capable of forming copies in two colors, said residual toner particles including toner particles of two different colors with the toner particles of one color being charged to one polarity and the the toner particles of the other color being charged to the opposite polarity, comprising:

means including a rotatable cleaning brush having a plurality of fibers adapted to be moved in contact with the insulating surface of said image bearing member, said fibers being comprised of two kinds of fibers each kind adapted to be charged to a polarity opposite that of the other, and;

flicker means for flicking said brush to cause toner particles to be removed therefrom as the brush rotates.

2. A device according to claim 1, wherein said brush is formed of a roller having a cylindrical core therein with two kinds of fiber materials charged to opposite polarities extending radially outwardly.

3. A device according to claim 2, wherein one of the fiber materials is a poly-4-fluoroethylene.

4. A device according to claim 3, wherein the other fiber material is a rayon material.

5. A device according to claim 3, wherein the other fiber material is a polyester material.

6. A device according to claim 2, wherein each kind of fiber is arranged in a uniform density but in a random mixture.

7. A device according to claim 2, wherein each area of said two kinds of fiber materials is alternately arranged in a helical pattern on a cylindrical core.

8. A device according to claim 7, wherein a pitch of each area of fiber materials is less than 50 mm.

9. A device according to claim 2, wherein each area of the fiber materials on the cylindrical core is formed in an alternate band pattern arranged in the axial direction.

10. A device according to the claim 2, wherein each area of the fiber materials on the cylindrical core is formed in a checkered pattern.

11. A device according to claim 10, wherein one kind of fiber materials is a poly-4-fluoroethylene.

12. A device according to the claim 2, wherein the area of one kind of fiber material is at a range of 20 to 80 percent of the total circumferential area of the core.

13. A device according to claim 12, wherein each kind of fiber is formed in a uniform density but in a random mixture.

14. A cleaning device for removing residual colored toner particles from the surface of a photoconductive drum in a copying machine capable of forming copies in two colors comprising:

means including a rotatable cleaning brush having two kinds of fiber material adapted to be charged to opposite polarities, flicker means for flicking said brush to cause the toner particles to be removed thereform as the brush rotates, and housing means for supporting said brush and said flicker means and preventing the removed toner particles from leaking from the cleaning device.

15. A cleaning device for removing residual toner particles from the insulating surface of an image bearing member of a device capable of forming copies in two colors, said residual toner particles including toner particles of two different colors with the toner particles of one color being charged to one polarity and the toner particles of the other color being charged to the opposite polarity, comprising:

means including a rotatable cleaning brush having a plurality of fibers adapted to be moved in contact with the insulating surface of said image bearing member, said fibers being comprised of two kinds of fibers including one kind of fiber formed of poly-4-fluoroethylene and adapted to be charged to a polarity opposite that of the toner particles of one of said colors, and another kind of fiber formed of an electrically conductive material, and flicker means for flicking said brush to cause toner particles to be removed therefrom as the brush rotates.

16. A device according to claim 15, wherein the ratio of the density of said poly-4-fluoroethylene fibers to the said another kind of fiber is in the range of 5 to 1/5.

17. A device according to claim 16, wherein the width of the area of each material is less than 30 mm.

* * * * *